US006672262B2

(12) United States Patent
Bontaz

(10) Patent No.: US 6,672,262 B2
(45) Date of Patent: Jan. 6, 2004

(54) PISTON COOLING NOZZLE

(75) Inventor: Christophe Bontaz, Marignier (FR)

(73) Assignee: Bontaz Centre, Marnaz (FR)

( * ) Notice: Subject to any disclaimer, the term of this patent is extended or adjusted under 35 U.S.C. 154(b) by 0 days.

(21) Appl. No.: 10/187,559

(22) Filed: Jul. 2, 2002

(65) Prior Publication Data

US 2003/0005893 A1 Jan. 9, 2003

(30) Foreign Application Priority Data

Jul. 4, 2001 (FR) ..... 01 09046

(51) Int. Cl.[7] ..... F01P 1/04
(52) U.S. Cl. ..... 123/41.35; 137/118.06
(58) Field of Search ..... 123/41.35; 137/118.02, 137/118.06

(56) References Cited

U.S. PATENT DOCUMENTS 2,800,119 A * 7/1957 Schmidl ..... 123/41.35

FOREIGN PATENT DOCUMENTS

| | | |
|---|---|---|
| DE | 2 141 518 | 2/1973 |
| EP | 0 460 299 A1 | 12/1991 |
| EP | 0 682 175 A1 | 11/1995 |
| EP | 0 947 285 A1 | 10/1999 |
| JP | 07317519 A | 5/1995 |

* cited by examiner

*Primary Examiner*—Noah P. Kamen
(74) *Attorney, Agent, or Firm*—RatnerPrestia

(57) ABSTRACT

A cooling nozzle in accordance with the invention cools the piston of an internal combustion engine. The nozzle includes a nozzle body with a penetrating part shaped to engage in a bore of the engine and to receive a cooling fluid. The nozzle includes an internal valve consisting of a piston guided and sliding in a guide bore of the nozzle body. The piston includes a head oriented in the upstream direction and bearing against an annular seat. The piston is urged towards the annular seat by a compression coil spring. The cooling nozzle for high-pressure engine cooling circuits and incorporating an internal valve obtained therefore has greater durability.

8 Claims, 7 Drawing Sheets

PISTON COOLING NOZZLE

BACKGROUND OF THE INVENTION

1. Field of the Invention

The present invention relates to nozzles, for cooling pistons of an internal combustion engine, which spray a cooling fluid such as oil onto the back of the piston, i.e. the face of the piston external to the combustion chamber, or in a piston tunnel.

2. Description of the Prior Art

The piston cooling nozzles usually employed are separate components, fixed to the engine housing and communicating with a cooling fluid feed orifice. The position of the nozzle is precisely determined to produce a jet of cooling fluid directed towards a precise area of the back of the piston or the piston tunnel.

Cooling nozzles generally include a valve to block the flow of cooling fluid until the pressure in the cooling circuit exceeds a particular threshold value.

Nozzle structures are generally employed in which the valve is a ball spring-loaded by a compression spring against a seat to shut off a cooling fluid passage. These structures are short and compact.

The inventors have found that the cooling nozzles with valves used until now operate correctly and prove satisfactory over a limited time period, after which wear interferes with the seal and correct operation of the valve. The period of correct operation decreases as the nominal pressure of the cooling fluid in the cooling pipes increases. Wear mainly modifies the opening characteristics of the valve, i.e. the fluid pressure required to open it: when new, the valve opens at a correct nominal pressure; when worn, the valve opens at a lower pressure, which can be as low as half the correct nominal pressure, and therefore at speeds below the engine idling speed. This interferes with the general pressure of the fluid in the engine.

The invention stems from the observation that the wear is inevitably caused by the structure of the ball valve itself: at high pressures the ball oscillates and vibrates, which causes the defects due to wear.

The document JP 07 317519 A discloses an engine cooling nozzle whose valve comprises a piston spring-loaded against a seat by a spring and sliding in an axial bore communicating with a radial fluid passage. The structure is long and bulky because opening of the valve necessitates movement and guidance of the piston downstream of the radial fluid passage.

SUMMARY OF THE INVENTION

The problem addressed by the present invention is that of designing a new structure for a nozzle incorporating a valve, and able to operate correctly over a significantly greater period of time, in particular without significant wear.

Surprisingly, the invention teaches that the ball valve can advantageously be replaced with a piston valve. Under similar conditions of use, at high pressure, a piston valve is not subject to the oscillation and vibration problems of ball valves, as a result of which satisfactory operation can be obtained over a significantly longer time period.

Another problem that the invention aims to solve is that of reducing the overall size of the nozzle within the engine cylinder. The piston valves from the document JP 07 317519 A yield a relatively large overall size, and in particular a relatively great length is required downstream of the outlet orifices of the valve for guiding the piston. An excessive length downstream of the outlet orifices of the valve leads to a risk of collision with rotating components of the engine such as the crankshaft or the crankshaft counterweight.

Accordingly, the invention aims to reduce the total length of the nozzle, and especially the length of the nozzle projecting into the engine cylinder downstream of the outlet structure with a radial fluid passage and an outlet tube.

To achieve the above and other objects, the invention provides a nozzle for cooling a piston of an internal combustion engine, including a nozzle body with a penetrating part shaped to engage in a bore of the engine and to receive a cooling fluid arriving via said bore, including an internal valve for modulating the flow of fluid as a function of its pressure, and including an outlet structure with a radial fluid passage in the nozzle body and an outlet tube, adapted to transmit cooling fluid leaving the internal valve and to direct it in the form of a jet at least against the back of the piston to be cooled; the internal valve includes a piston, having a downstream section with a cylindrical lateral guide surface sliding longitudinally in a guide bore in the nozzle body, having a head oriented in the upstream direction defined with respect to the direction of flow of the cooling fluid to bear selectively against an annular seat in the nozzle body and through which the cooling fluid flows, and the internal valve includes a compression coil spring, engaged axially between a downstream bearing surface in the nozzle body and a downstream surface of the piston to urge the piston in the upstream direction against the annular seat.

This kind of structure is very durable and very stable, which reduces oscillations and very significantly reduces wear phenomena.

According to the invention, the guide bore in which the piston slides is essentially inside an upstream section of the nozzle body, on the upstream side of the radial fluid passage, and fluid passages convey the fluid axially from the downstream side of the annular seat to the radial fluid passage as soon as the piston moves off the annular seat, so that, when the internal valve is open, the piston is substantially on the upstream side of the radial fluid passage.

The downstream section of the piston advantageously includes a downstream coaxial portion in which the upstream end part of the compression coil spring is engaged and guided.

In a first embodiment, the nozzle body has an axial through bore, in which is engaged without clearance and retained in position a tubular jacket with an axial bore, a downstream section of which forms the guide bore receiving the downstream section of the piston, the tubular jacket having an internal intermediate shoulder forming the annular seat, at least one radial hole being provided in the wall of the tubular jacket immediately downstream of the annular seat to convey fluid radially towards one or more peripheral passages between the external surface of the tubular jacket and the surface of the axial through bore of the nozzle body, said peripheral passages being adapted to convey cooling fluid axially from the radial hole or holes to the radial fluid passage in the nozzle body. In this way, when the valve is open, the piston is on the upstream side of the radial fluid outlet passage.

For example, the peripheral passage or passages comprise a larger diameter section of the axial through bore, whereas the tubular jacket has a substantially constant outside diameter leaving an annular intermediate space in which the cooling fluid flows.

It is preferable for the tubular jacket to be made of sintered steel, while the piston is made of steel. This considerably promotes sliding between the piston and the jacket, so reducing wear phenomena and the risks of binding.

In another embodiment, the piston includes, between its downstream section with its cylindrical lateral guide surface and the head, an external annular recess defining, with the wall of the guide bore, an annular housing communicating via radial piston holes with an axial piston bore open in the downstream direction into the axial passage through the body that conveys the cooling fluid to the radial fluid passage in the nozzle body. In this way, when the valve is open, the piston is well upstream of the radial fluid outlet passage.

The annular seat can be an annular ring mounted in the axial bore passing through the body of the nozzle.

BRIEF DESCRIPTION OF THE DRAWINGS

Other objects, features and advantages of the present invention will emerge from the following description of particular embodiments of the invention, given with reference to the accompanying drawings, in which.

DETAILED DESCRIPTION OF THE PREFERRED EMBODIMENTS

Figure 1:
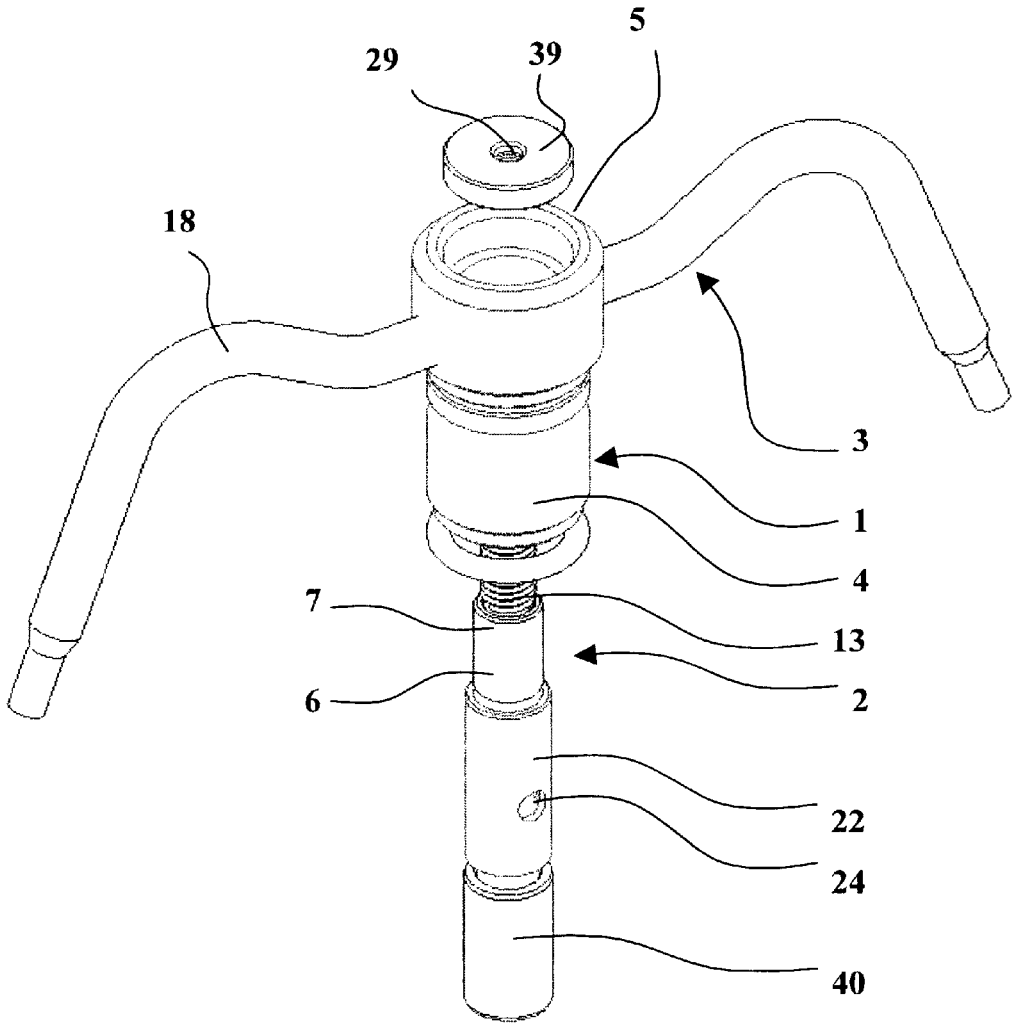
FIG. 1 is an exploded perspective view of a first embodiment of a nozzle structure according to the present invention.

In both the embodiments shown in the drawings, a piston cooling nozzle for an internal combustion engine includes a nozzle body 1, an internal valve 2, and an outlet structure 3 adapted to convey the cooling fluid leaving the valve and direct it in the form of a jet at least against the back of a piston to be cooled.

The nozzle body 1 has a penetrating part 4, shaped so that it can be inserted into a bore in the engine and to receive a cooling fluid arriving via said bore in the engine. The nozzle body 1 has a projecting part 5, intended to project into the engine cylinder and to carry the outlet structure 3.

In both embodiments, the internal valve 2 includes a piston 6 having a downstream section 7 with a cylindrical lateral guide surface 8 sliding longitudinally in a guide bore 9 in the nozzle body 1. The piston 6 includes a head 10, oriented in the upstream direction defined relative to the direction of flow of the cooling fluid, adapted to bear selectively against an annular seat 11 fastened to the nozzle body 1, and including a seat bore 12 for the cooling fluid to pass through.

The internal valve 2 further includes a compression coil spring 13, located axially between a downstream bearing surface 14 of the nozzle body 1 and a downstream surface 15 of the piston 6 to urge the piston 6 in the upstream direction against the annular seat 11.

As it moves along the longitudinal axis I—I of the nozzle, the piston 6 is guided perfectly, which avoids all risk of oscillation and instability, which makes the nozzle more durable and less subject to wear.

The outlet structure 3 includes at least a radial fluid passage 17 in the nozzle body 1, and at least an outlet tube 18 having a first end force-fitted into the corresponding radial fluid passage 17.

The piston 6 slides between a valve closed position and a valve open position in the guide bore 9 inside an upstream section 16 of the nozzle body 1 on the upstream side of the radial fluid passage 17. In the valve open position, the piston 6 is essentially on the upstream side of the radial fluid passage 17.

Thus, the piston sliding in sealed fashion in the guide bore 9 necessarily opposes the flow of fluid between the annular seat 11 and the radial fluid passage 17. To provide for the passage of the fluid, in both embodiments of the invention shown, fluid passages convey the fluid axially from the downstream side of the annular seat 11 to a radial fluid passage 17 as soon as the piston moves off the annular seat 11. These fluid passages are described hereunder, and have different structures in the two embodiments shown.

To enable the use of a long compression coil spring 13 without increasing the length of the part 5 of the nozzle projecting into the engine cylinder, the downstream section 7 of the piston 6 includes a downstream coaxial housing 19 in which the upstream end part 20 of the compression coil spring 13 is engaged and guided.

In both embodiments, the nozzle body 1 has an axial bore 21 passing through it along the axis I—I of the nozzle body 1, in which the piston 6 slides axially.

Figure 2:
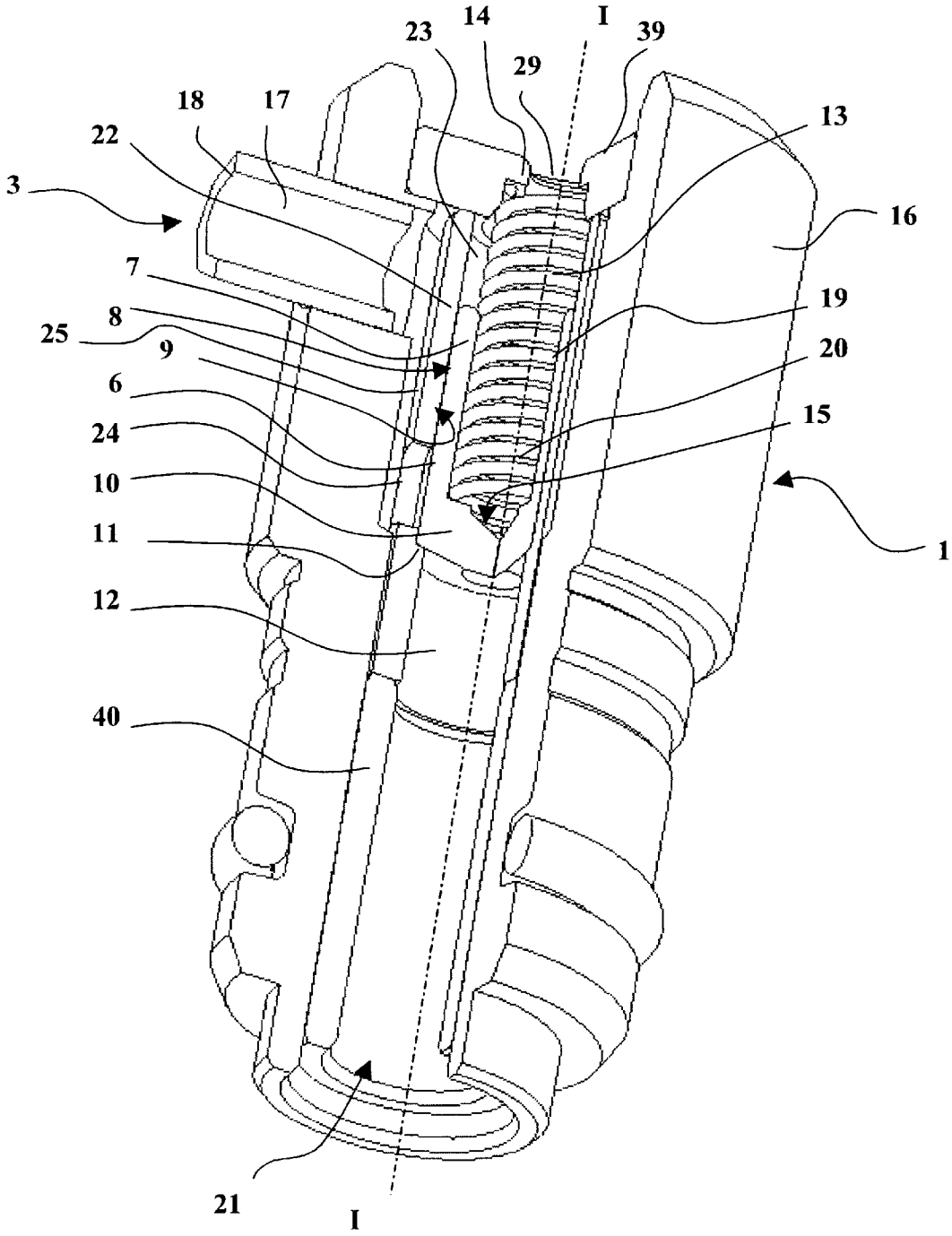
FIG. 2 is a perspective view partly in section of the assembled nozzle from FIG. 1.
Figure 3:
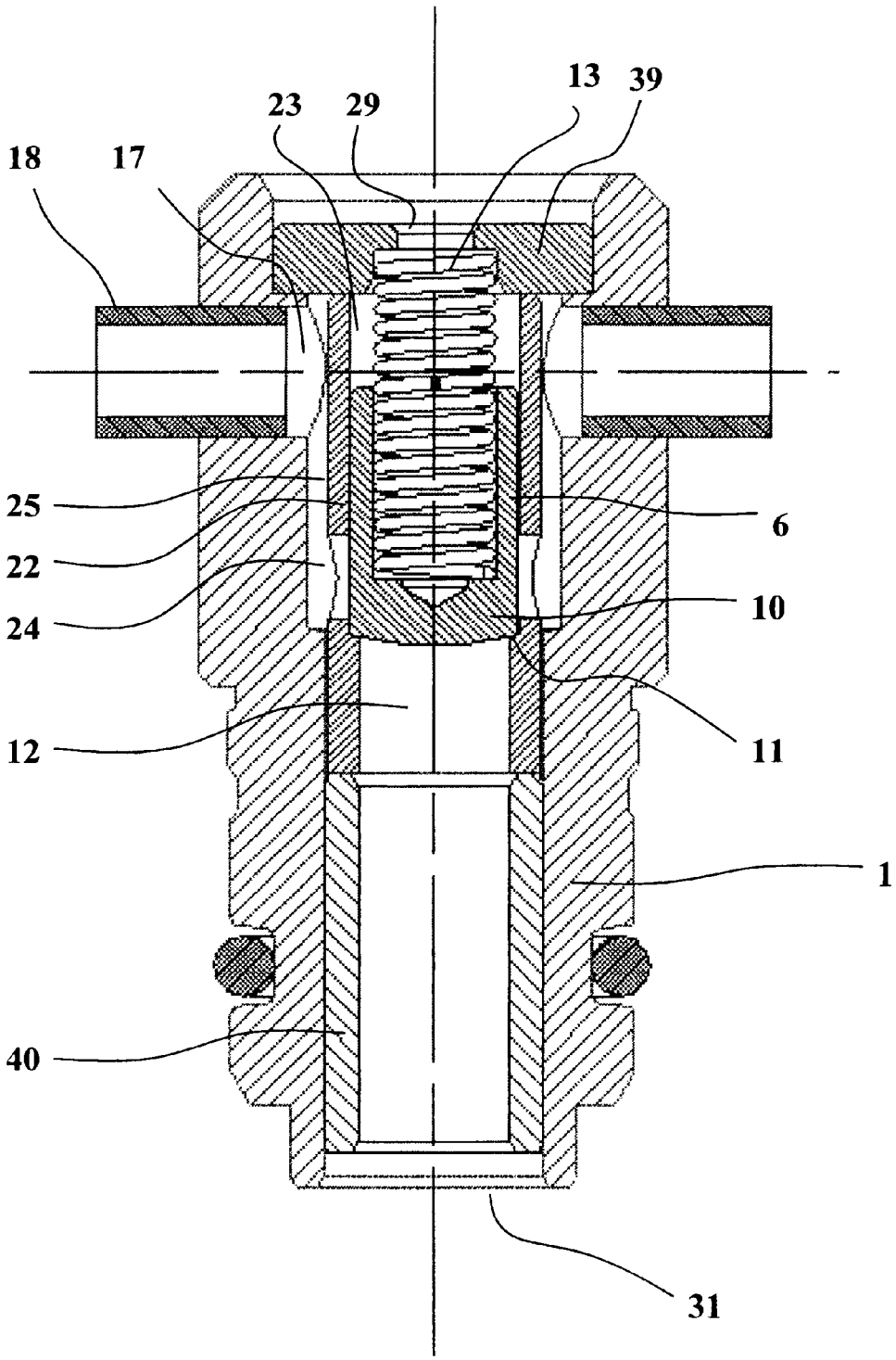
FIG. 3 is a front view in longitudinal section of the nozzle from FIGS. 1 and 2, showing how it functions.

In the embodiment shown in FIGS. 1 to 3, a tubular jacket 22 is inserted without clearance and held in position in the axial through bore 21 in the projecting part 5 of the nozzle between a downstream plug 39 and an upstream ring 40. The tubular jacket 22 includes an axial bore 23 with a downstream section that forms a guide bore 9 receiving the downstream section of the piston 6.

The tubular jacket 22 has an internal intermediate shoulder forming the annular seat 11.

At least one radial hole 24 in the wall of the tubular jacket 22, immediately downstream of the annular seat 11, conveys the fluid radially to one or more peripheral passages 25 provided between the external surface of the tubular jacket 22 and the surface of the axial through bore 21 of the nozzle body 1. The peripheral passages 25 are adapted to convey the cooling fluid axially from the radial hole or holes 24 to the radial fluid passage 17 in the nozzle body 1.

In this way, the piston 6 can be on the upstream side of the radial fluid passage 17 in the nozzle body 1 at all times, and the projecting part 5 can therefore have a small volume.

In the embodiment shown in FIGS. 1 to 3, the peripheral passages 25 are provided by a larger diameter section of the axial through bore 21, whereas the tubular jacket 22 has a substantially constant outside diameter, leaving an annular intermediate space in which the cooling fluid flows.

In this embodiment, the tubular jacket 22 can advantageously be made of sintered steel, while the piston 6 is made of steel. This produces a very low coefficient of friction, and good lubrication between the piston 6 and the tubular jacket 22, facilitating movements of the piston without wear and reducing the risks of binding.

This first embodiment also favors the stability of the valve, because the valve is subjected on the upstream side to the cooling fluid pressure, but on the downstream side only to the pressure of the air and to the return force of the spring. The valve is therefore either open when the fluid pressure is greater than the spring force or closed otherwise, but never vibrates between the two positions.

Figure 4:
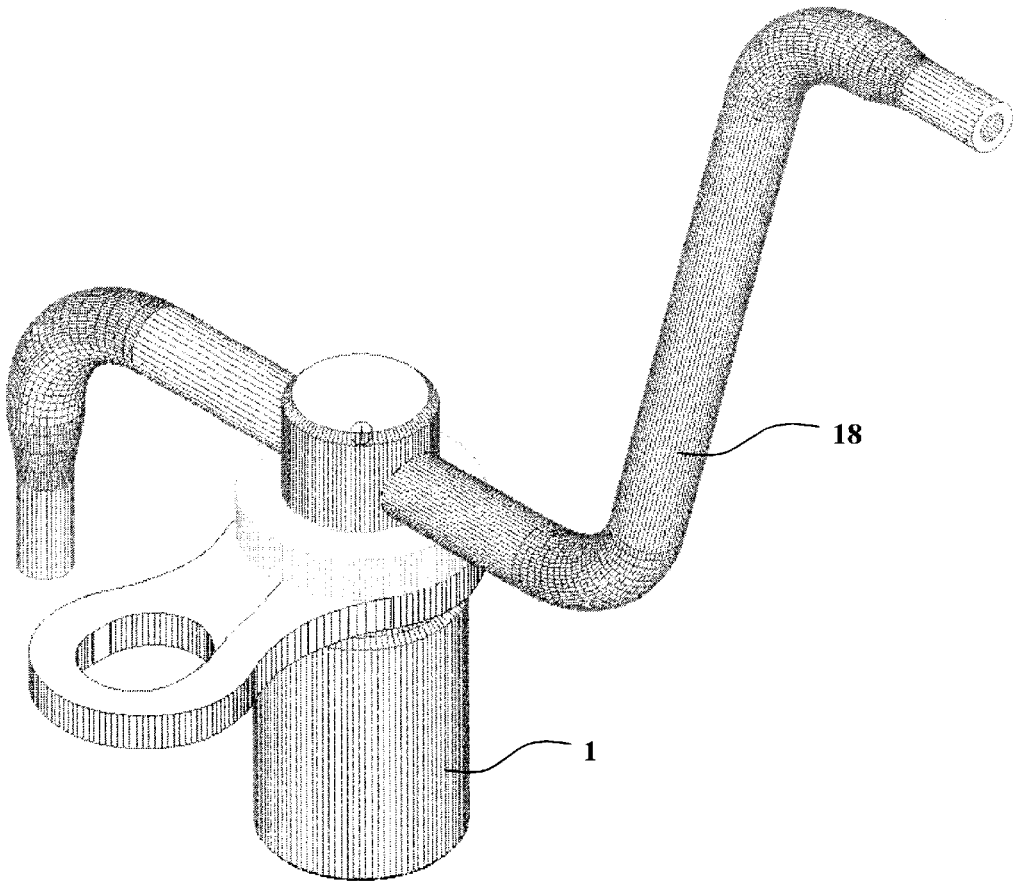
FIG. 4 is an exploded perspective view of a second embodiment of a nozzle according to the present invention.
Figure 5:
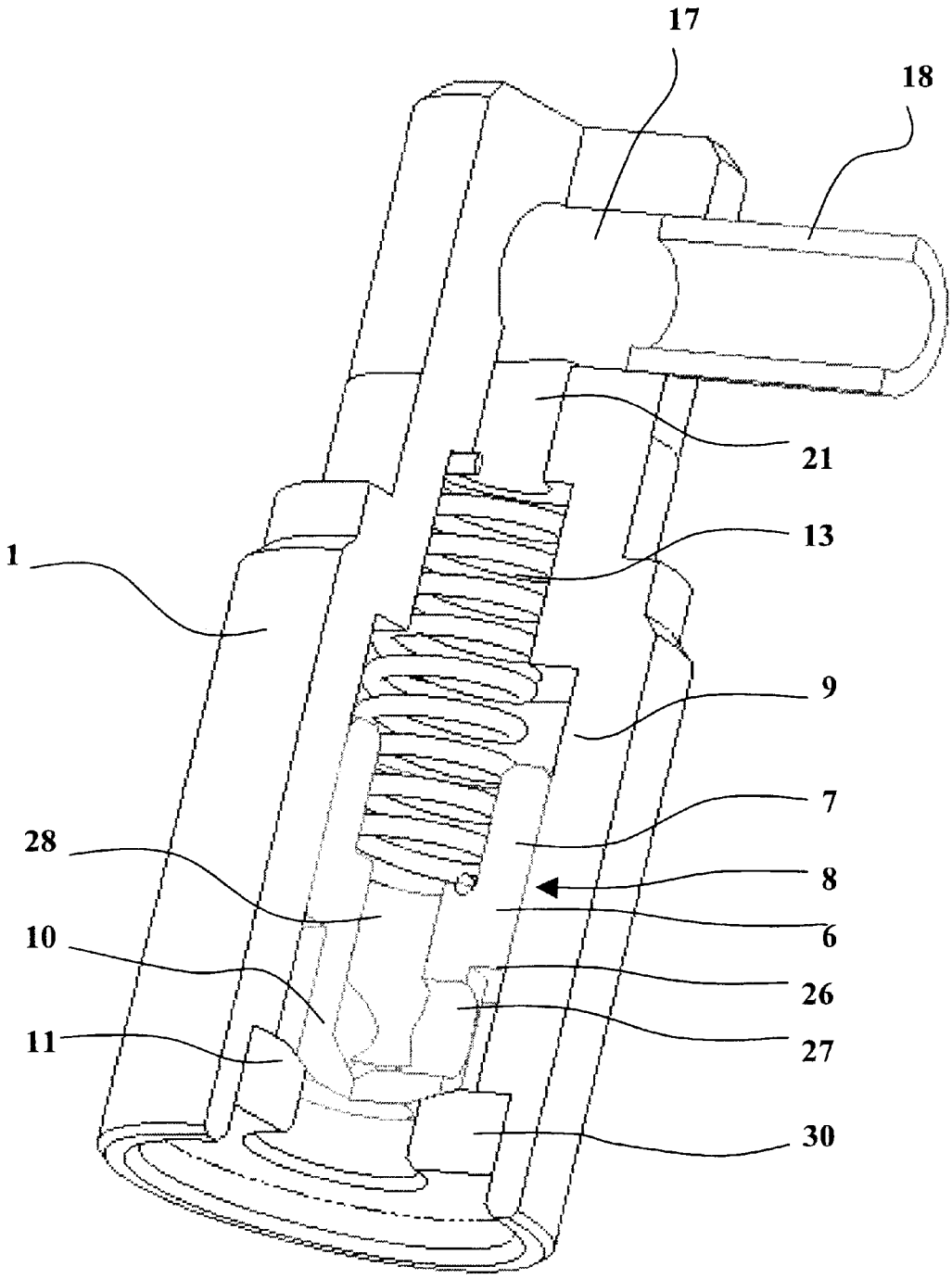
FIG. 5 is a perspective view partly in section of the assembled nozzle from FIG. 4.
Figure 6:
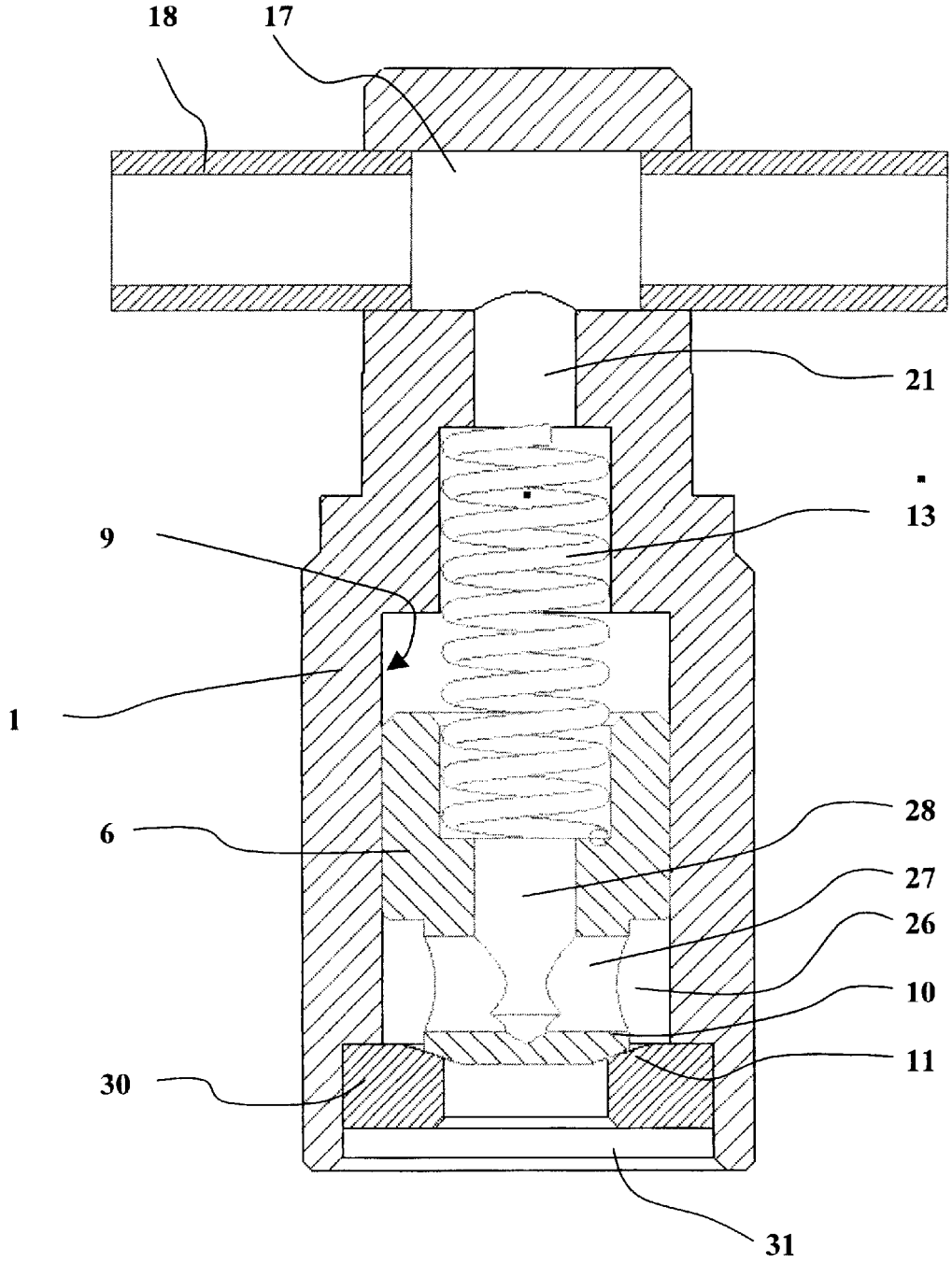
FIG. 6 is a front view in longitudinal section of the nozzle from FIGS. 4 and 5, showing how it functions.

In the embodiment of FIGS. 4 to 6, a nozzle body 1 has the same essential features as in the previous embodiment, these features being indicated by the same reference numbers, so that it is not necessary to describe these features again. See the drawings.

In this second embodiment, the piston 6 has, between its downstream section 7 with its cylindrical lateral guide surface 8 and the head 10, an external annular recess 26 defining, with the wall of the guide bore 9, an annular housing communicating via radial piston holes 27 with an axial piston bore 28 open in the downstream direction into the axial bore 21 through the body that conveys the cooling fluid to the radial fluid passage 17 in the nozzle body 1.

With this second structure the piston 6 can also be at all times on the upstream side of the radial fluid passage 17 in the nozzle body 1, providing axial passage of the fluid from the annular seat 11 to the radial fluid passage 17.

In the first embodiment of FIGS. 1 to 3, a vent 29 is provided on the downstream side of the housing containing the compression coil spring 13, this vent 29 enabling air to enter and leave the spring housing when the piston 6 moves. The vent 29 is formed in the downstream plug 39.

On the other hand, in the second embodiment of FIGS. 4 to 6, it is not necessary to provide a vent on the downstream side of the compression coil spring 13, as the fluid escapes via the cooling fluid passages.

In this second embodiment, the annular seat 11 is an annular ring 30, fixed into the axial bore 21 through the nozzle body.

The operation of the nozzle is explained with reference to FIGS. 3 and 6.

The cooling fluid arrives at upstream end 31 via a bore in the engine block. If the pressure of the cooling fluid is greater than a predetermined threshold, the fluid pushes the piston 6 back against the return force exerted by the compression coil spring 13, with the result that the cooling fluid can pass between the head 10 and the annular seat 11.

In the FIG. 3 embodiment, the cooling fluid passes radially through the radial holes 24, and then axially along the peripheral passages 25 until it reaches the radial fluid passage 17 and exits via the outlet tubes 18.

In the FIG. 6 embodiment, the cooling fluid flows between the annular seat 11 and the head 10, is distributed in the external annular recess 26, travels radially towards the center via the radial piston holes 27, and then travels axially in the axial piston bore 28 and then in the axial bore 21 through the body which conveys the cooling fluid to the radial fluid passage 17 and the outlet tube 18.

Figure 7:
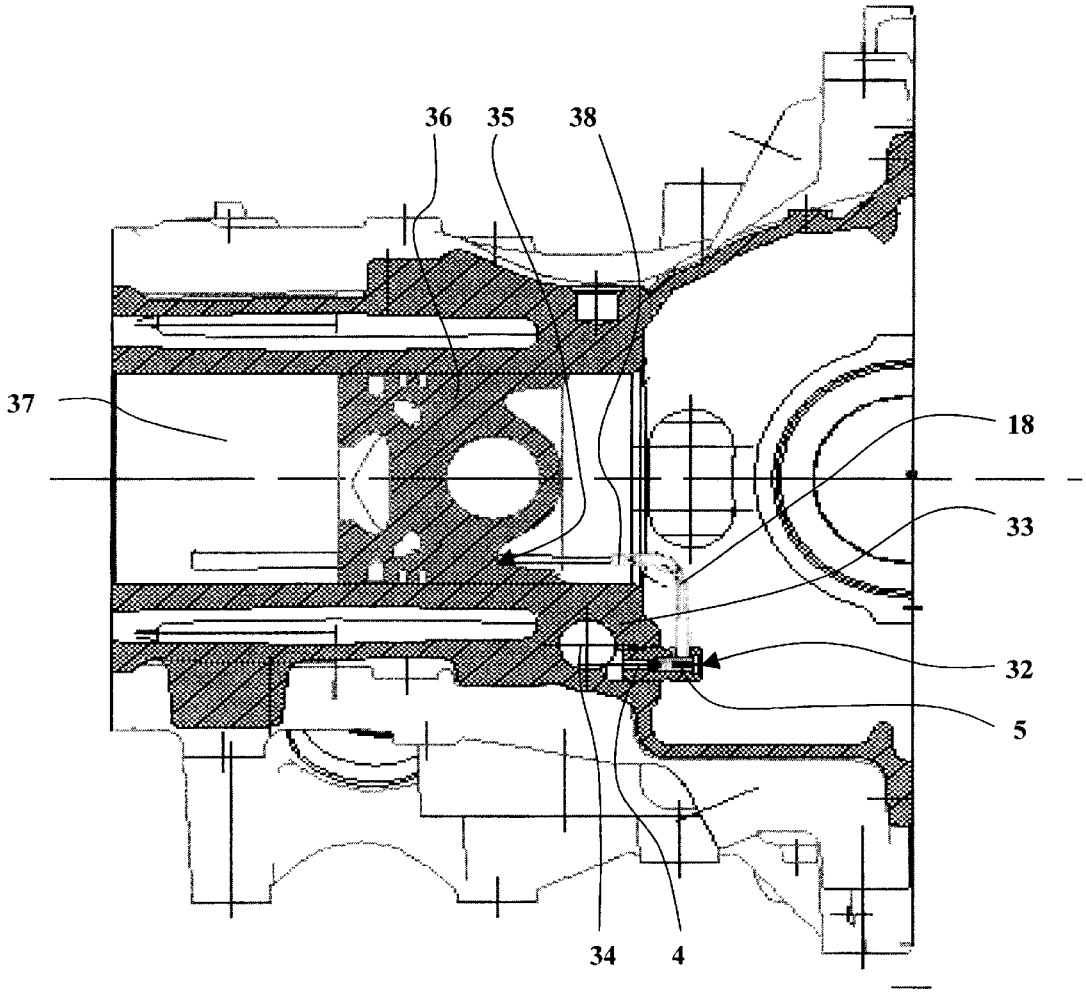
FIG. 7 shows a nozzle according to the invention incorporated in an internal combustion engine.

FIG. 7 shows a nozzle in accordance with the invention installed in an internal combustion engine. The figure shows a portion of the engine including one half of an engine cylinder.

The nozzle 32 is attached to the wall of the cylinder casing 33, inside the engine, to take up cooling fluid flowing in a cooling pipe 34 and spray the cooling fluid into the engine cylinder, against the back 35 of the piston 36 of the engine, i.e. against the face of the piston of the engine that is outside the combustion chamber 37.

The penetrating part 4 of the nozzle 32 is engaged in a corresponding bore of the cylinder casing 33, communicating with the cooling passage 34. Thus the nozzle is fixed by any known means, for example force-fitted or screwed into the corresponding bore of the cylinder casing 33. The projecting part 5 of the nozzle 32 extends into the interior of the engine cylinder. The outlet tube 18 can be seen, and is curved so that its outlet orifice 38 is directed upwards, against the back 35 of the piston 36.

An internal combustion engine can advantageously include a plurality of cooling nozzles with pistons in accordance with the invention, as previously described, fixed into the piston chamber or chambers and each adapted to spray the cooling fluid in a concentrated jet onto the back of a piston.

The present invention is not limited to the embodiments just described, but includes variants and generalizations thereof within the scope of the following claims.

What is claimed is:

1. A nozzle for cooling a piston of an internal combustion engine, including a nozzle body with a penetrating part shaped to engage in a bore of the engine and to receive a cooling fluid arriving via said bore, including an internal valve for modulating the flow of fluid as a function of its pressure, and including an outlet structure with a radial fluid passage in the nozzle body and an outlet tube, adapted to transmit cooling fluid leaving the internal valve and to direct it in the form of a jet at least against the back of the piston to be cooled, the internal valve including a piston, having a downstream section with a cylindrical lateral guide surface sliding longitudinally in a guide bore in the nozzle body, having a head oriented in the upstream direction defined with respect to the direction of flow of the cooling fluid to bear selectively against an annular seat in the nozzle body and through which the cooling fluid flows, and the internal valve including a compression coil spring, engaged axially between a downstream bearing surface in the nozzle body and a downstream surface of the piston to urge the piston in the upstream direction against the annular seat, wherein the guide bore in which the piston slides is essentially inside an upstream section of the nozzle body, on the upstream side of the radial fluid passage, and fluid passages convey the fluid axially from the downstream side of the annular seat to the radial fluid passage as soon as the piston moves off the annular seat, so that, when the internal valve is open, the piston is substantially on the upstream side of the radial fluid passage.

2. A cooling nozzle according to claim 1, wherein the downstream section of the piston includes a downstream coaxial portion in which the upstream end part of the compression coil spring is engaged and guided.

3. A cooling nozzle according to claim 1, wherein the nozzle body has an axial through bore, in which is engaged without clearance and retained in position a tubular jacket with an axial bore, a downstream section of which forms the guide bore receiving the downstream section of the piston, the tubular jacket having an internal intermediate shoulder forming the annular seat, at least one radial hole being provided in the wall of the tubular jacket immediately downstream of the annular seat to convey fluid radially towards one or more peripheral passages between the external surface of the tubular jacket and the surface of the axial through bore of the nozzle body, said peripheral passages being adapted to convey cooling fluid axially from the radial hole or holes to the radial fluid passage in the nozzle body.

4. A cooling nozzle according to claim 3, wherein the peripheral passage or passages comprise a larger diameter section of the axial through bore, whereas the tubular jacket has a substantially constant outside diameter leaving an annular intermediate space in which the cooling fluid flows.

5. A cooling nozzle according to claim 3, wherein the tubular jacket is made of sintered steel, while the piston is made of steel.

6. A cooling piston according to claim 1, wherein the piston includes, between its downstream section with its cylindrical lateral guide surface and the head, an external annular recess defining, with the wall of the guide bore, an annular housing communicating via radial piston holes with an axial piston bore open in the downstream direction into the axial passage through the body that conveys the cooling fluid to the radial fluid passage in the nozzle body.

7. A cooling nozzle according to claim 6, wherein the annular seat is an annular ring fixed into the axial bore through the nozzle body.

8. An internal combustion engine including at least one nozzle incorporating a piston as claimed in claim 1.

* * * * *